US011239621B2

(12) United States Patent
Riedel et al.

(10) Patent No.: US 11,239,621 B2
(45) Date of Patent: Feb. 1, 2022

(54) DOUBLE-ROW PLUG FOR A RIBBON OR FOIL CABLE, METHOD FOR THE PRODUCTION THEREOF, AND APPARATUS FOR THE TRANSMISSION OF CURRENT

(71) Applicant: NEXANS, Courbevoie (FR)

(72) Inventors: Richard Riedel, Floss (DE); Alexander Steinert, Floss (DE); Stefan Kleber, Eslarn (DE); Karl Schweigl, Eslarn (DE)

(73) Assignee: NEXANS, Courbevoie (FR)

( * ) Notice: Subject to any disclaimer, the term of this patent is extended or adjusted under 35 U.S.C. 154(b) by 0 days.

(21) Appl. No.: 16/986,487

(22) Filed: Aug. 6, 2020

(65) Prior Publication Data

US 2021/0044068 A1 Feb. 11, 2021

(30) Foreign Application Priority Data

Aug. 8, 2019 (EP) ..... 19315086

(51) Int. Cl.
*H01R 43/16* (2006.01)
*H01R 13/04* (2006.01)
(Continued)

(52) U.S. Cl.
CPC ..... *H01R 43/16* (2013.01); *H01R 13/04* (2013.01); *H01R 24/28* (2013.01); *H01R 12/65* (2013.01); *H01R 43/24* (2013.01)

(58) Field of Classification Search
CPC ..... H01R 43/16; H01R 43/24; H01R 12/65; H01R 13/04; H01R 24/28
(Continued)

(56) References Cited

U.S. PATENT DOCUMENTS 6,031,445 A * 2/2000 Marty ..... H01F 27/2804 257/E21.022
6,114,937 A * 9/2000 Burghartz ..... H01F 17/0006 336/200
(Continued)

FOREIGN PATENT DOCUMENTS

| | | |
|---|---|---|
| DE | 10009653 | 9/2000 |
| FR | 2719712 | 11/1995 |
| WO | 2013122740 | 8/2013 |

OTHER PUBLICATIONS

International Search Report dated Mar. 12, 2020.

*Primary Examiner* — Peter G Leigh
(74) *Attorney, Agent, or Firm* — Sofer & Haroun, LLP

(57) ABSTRACT

An electrically conductive, single-piece flat part (100) for a plug with first and second contact pins (112, 114) are arranged in two parallel rows, and with a connector region for a cable. The part has a connecting element (102). Conductors (108, 110) which open into the first and second contact pins (112, 114) extend from the first and from the second side of the connecting element, the conductors (108, 110) which lie on the opposite sides of the connecting element (102) being connected to the connecting element (102) in a manner which is offset with respect to one another in such a way that the imaginary straight extension of a conductor (108, 110) runs on the one side of the connecting element (102) next to one or between two conductors (108, 110) on the opposite side of the connecting element (102). The first contact pins (112) are connected via an offset region (132) to the first conductors (108) which extend from the first side of the connecting element (102), which offset region (132) compensates for the offset of the first and second conductors (108, 110) on the connecting element (102).

12 Claims, 10 Drawing Sheets

(51) Int. Cl.
*H01R 24/28* (2011.01)
*H01R 12/65* (2011.01)
*H01R 43/24* (2006.01)

(58) Field of Classification Search
USPC ..... 439/606
See application file for complete search history.

(56) References Cited

U.S. PATENT DOCUMENTS 6,291,872 B1 * 9/2001 Wang ..... H01F 17/0013 257/531
6,476,704 B2 * 11/2002 Goff ..... H01F 17/0006 29/602.1
7,064,411 B2 * 6/2006 Hashizume ..... H01F 17/0006 257/516
7,570,144 B2 * 8/2009 Lim ..... H01F 17/0006 336/200
7,663,607 B2 * 2/2010 Hotelling ..... G06F 3/044 345/173
7,775,800 B2 * 8/2010 Reischl ..... H01R 35/025 439/15
7,875,814 B2 * 1/2011 Chen ..... G06F 3/0412 178/18.07
8,242,872 B2 * 8/2012 Lim ..... H01F 27/2804 336/200
8,836,078 B2 * 9/2014 Cho ..... H01L 23/5227 257/531
9,929,084 B2 * 3/2018 Gonzalez Jimenez ..... H01L 23/522
10,553,353 B2 * 2/2020 Vanukuru ..... H01F 17/0013
2002/0168885 A1 * 11/2002 Araki ..... H01R 35/025 439/164
2004/0017278 A1 * 1/2004 Castaneda ..... H01F 21/12 336/200
2005/0128038 A1 * 6/2005 Hyvonen ..... H01L 23/5225 336/182
2008/0254646 A1 10/2008 Reischl et al.
2009/0194344 A1 * 8/2009 Harley ..... G06F 3/0446 178/18.06
2011/0133875 A1 * 6/2011 Chiu ..... H01L 23/5227 336/200

* cited by examiner

DOUBLE-ROW PLUG FOR A RIBBON OR FOIL CABLE, METHOD FOR THE PRODUCTION THEREOF, AND APPARATUS FOR THE TRANSMISSION OF CURRENT

RELATED APPLICATION

This application claims the benefit of priority from European Patent Application No. 19 315 086.9, filed on Aug. 8, 2019, the entirety of which is incorporated by reference.

FIELD OF THE INVENTION

The invention relates to a double-row plug for a ribbon or foil cable, in particular an electrically conducting, single-piece flat part for producing the plug. Moreover, the invention relates to a method for producing the double-row plug, and to an apparatus for the transmission of current with a ribbon or foil cable and one or two plugs produced according to the method.

BACKGROUND

Ribbon or foil cables are used, inter alia, when a multiplicity of electric connections is guided over an articulated mechanical connection, for example hinges or rotational axes which are limited in terms of their rotation by end stops, for instance in steering systems of vehicles. Ribbon cables are multicore cables, in which the cores are not arranged in a circularly bundled manner in a round sheath, but rather are guided in parallel next to one another.

The contacting of ribbon cables takes place as a rule by means of what are known as header connectors which, in particular in the case of solid conductors, are preferably connected to the ribbon cable using insulation displacement technology. Here, insulation displacement connectors of the plug-in connector which are adapted to the spacing of the cores in the ribbon cable are positioned with respect to the cores and are pressed in by means of a tool, the insulation displacement connectors cutting through the insulation of the cores and establishing the electric contact. The insulation displacement technology is less suitable precisely in the case of stranded conductors which make greater flexibility and smaller bending radii possible. The establishing of contact of the header plugs takes place perpendicularly with respect to the plane of the ribbon cable, with the result that the plugs which are attached at the ends of the ribbon cable require an installation space with a minimum height at the mounting location. Even if the ribbon cable is bent over directly at the exit from the plug, the required installation space is significantly greater than the width of the plug itself as a result of the minimum bending radius which is to be maintained.

Foil cables which are also known as Flat Flex Cables or FFCs are similar to ribbon cables in terms of the arrangement of the conductors in one plane next to one another, but do not use any strands, but rather conductor tracks which are applied to a permanently flexible, electrically insulating carrier material and the ends of which can be plugged directly onto or into plug-in connectors which are intended for this purpose. Foil cables are particularly satisfactorily suitable for laying through very narrow openings and are very hard-wearing even with respect to repeated bends above a minimum bending radius. In addition, even directional changes in one plane can be achieved very easily by way of foil cables, as long as the bending or folding points which are required to this end are not subjected to repeated mechanical bending or folding movements.

Foil cables are very satisfactorily suitable for electric contacts of parts which are mounted such that they can be rotated axially with respect to one another, but do not require completely free rotatability without an end stop on both sides.

One example for an application of this type is the steering column of a vehicle, which steering column has to be capable of being rotated out of a centre position to the left or to the right to a limited extent. An airbag is frequently arranged in a steering wheel which is attached to the steering column, which airbag has to be connected electrically to a corresponding control unit for triggering purposes. Moreover, operating elements for different vehicle functions are arranged in many steering wheels, which operating elements are likewise connected electrically to the corresponding control units. It would be possible for free rotatability to be achieved by way of slip ring contacts, but their absolute reliability, as is necessarily required for instance in the case of airbags, can be achieved over a long use time period, for example a use period of a vehicle which frequently lies above 10 years, only with high complexity, if at all. In addition to the wear, slip rings are disadvantageous on account of fluctuating contact resistances, in particular in the case of low current strengths.

In the case of electric connections by means of foil cables of components which can be rotated to a limited extent with respect to one another, the foil cable is wound up here helically in a similar manner to a spring in a spring barrel of a clock movement. In the case of a relative rotational movement of the two terminals which are connected by way of the foil cable, the wound-up foil cable "breathes" like the spring of a clock. The windings are tightened to a small diameter in the one rotational direction. In the other rotational direction, they open again to a larger diameter. The conductors of an outgoing line can be connected to the stripped conductors of the foil cable. An arrangement of this type is known, for example, from DE 41 19 769 A1.

Another, related embodiment uses a ribbon cable which is wound up here helically in the opposite direction and is arranged on an axis which is parallel to the rotational axis of the parts which can be rotated with respect to one another. Here, the foil cable is wound up in the manner of a bifilar coil. If the two ends thereof are pulled in the opposite direction, the bifilar coil which is produced by way of the winding has its diameter reduced. As a consequence of the elasticity of the foil cable, it winds up again when the tensile forces which act on its ends stop. An arrangement of this type is likewise known from DE 41 19 769 A1.

In the case of the known applications of ribbon or foil cables, making contact at the ends remains a persistent problem, in particular if a double-row plug is to be connected to the conductors of the ribbon or foil cable which are arranged in parallel in one plane.

Proceeding herefrom, it is the object of the present invention to provide a double-row plug for the connection of a ribbon of foil cable, which plug overcomes or at least improves one or more of the problems which were mentioned at the outset.

SUMMARY OF THE INVENTION

In order to achieve the said object, the invention proposes, according to a first aspect, an electrically conductive, single-piece flat part which is utilized, according to a second aspect, in a method for producing a double-row plug. In a third aspect, the invention proposes a double-row plug and an apparatus for the transmission of current with a double-row plug according to the invention.

An electrically conductive, single-piece flat part according to the first aspect for a plug with first and second contact pins which are arranged in two parallel rows, and with a connector region for a cable, the conductors of which lie in one plane next to one another, comprises a connecting element with a second side which lies opposite a first side. The connecting element can be, for example, a rectangular frame, or a web-shaped or strip-shaped connecting element. Conductors which open into the first and second contact pins extend from the first and from the second side of the connecting element. Here, the conductors which lie on the opposite sides of the connecting element are connected to the connecting element in a manner which is offset with respect to one another in such a way that the imaginary extension of a conductor runs on the one side of the connecting element next to or between the connecting points of one or two conductors on the opposite side. The first contact pins are connected via an offset region to the first conductors which extend from the first side of the connecting element, which offset region compensates for the offset of the first and second conductors at their connection to the connecting element.

In the case of one or more refinements, in each case two adjacent contact pins which are connected to the same side of the connecting element are connected to one another in a manner which is spaced apart from their ends by way of webs. The spacing from the ends of the contact pins is preferably selected in such a way that, in the case of the production of a plug, the webs lie with the flat part within a body of the plug, with the result that those sections of the conductors and/or contact pins which are directly adjacent with respect to the webs are fixed spatially, and the webs can be removed or interrupted, for example, by way of being punched out.

In the case of one or more refinements, the contact pins which are connected to the first side of the connecting element run in each case at a first spacing from the connecting element at a first angle with respect to the direction, from which the conductors which are connected to them extend from the connecting element. The first spacing can be different for each of the contact pins, with the result that the contact pins still lie in one plane. Accordingly, the contact pins which are connected to the second side of the connecting element run in each case at a second spacing from the connecting element at a second angle with respect to the direction, from which the connectors which are connected to them extend from the connecting element. The second spacing for each of the contact pins can also be different here, with the result that the contact pins continue to lie in one plane. The first and second spacings of the contact pins which are connected to the first and the second side of the connecting element can also differ between two contact pins, the conductors of which follow one another in each case in an alternating manner on different sides of the connecting element, and which lie above one another in a plug which is produced using the flat part. The different spacings can stem from the fact, inter alia, that sections of the conductors which extend from one side of the connecting element are moved out of the plane of the flat part into a plane which runs parallel with respect to it by way of additional bending operations.

The first and the second angle are mirror-inverted at a folding axis which runs transversely with respect to a direction, in which the first and second conductors extend from the connecting element. The folding axis can intersect the connecting element symmetrically in the centre between the first and the second side, but can also be offset in parallel with respect thereto.

The conductors can also run in sections in other directions between the connecting element and the contact pins, the conductors always running in one plane and not being in contact with one another apart from at the connecting element and at webs which are provided between the conductors in one or more refinements.

In the case of one or more refinements, the contact pins which are connected to the first side of the connecting element end at a greater spacing from a third side which connects the first and the second side of the connecting element than the contact pins which are connected to the second side of the connecting element. This refinement also serves to compensate for the spacing of the contact pins from the connecting element, which spacing is reduced in the case of additional bending operations, by means of which sections of the conductors are moved out of the plane of the flat part into a plane which runs parallel with respect thereto, with the result that the rows of the contact pins lie parallel to one another and are equally long after the bending operations in the case of the production of a plug.

It is of course also possible in the case of each of the refinements described herein for individual contact pins to be of longer or shorter configuration in a targeted manner than other contact pins, in order to obtain leading or trailing contacts, that is to say contacts which establish an electric connection before or after other contacts in the case of the plug and socket being brought together.

The flat part can be, for example, a part which is punched from a sheet, a plate or a foil, or a part which is produced on a flat carrier by way of an additive method, for example a printed or sintered part. Here, the sheet can consist of a suitable electrically conductive metal or an electrically conductive alloy, and the plate or film can consist of electrically conductive metals or alloys or electrically conductive plastics, or of planar structures which are assembled therefrom. In addition to one or two electrically conductive outer layers, an assembled structure comprises an inner layer which is coated with and connected to the former, and itself consists of an electrically non-conductive material. In this way, two electric connections can be established per contact. A plug which is produced by way of this might be contacted, for example, from two sides by way of foil conductors, and might thus make doubling of the number of contacts possible in the case of an identical spatial requirement of the plug. Here, the flat part can preferably be cold-workable and is preferably still dimensionally stable enough, even after reshaping, that the contact pins of a plug which is produced by way of it maintain their shape even in the case of multiple plug-in operations.

Accordingly, a method for producing an above-described flat part comprises providing of a plate or a sheet made from an electrically conductive material, and punching of the connecting element, and the conductors and contact pins which are connected thereto, the punching preferably taking place in a single step.

Accordingly, an alternative method for producing an above-described flat part comprises providing of a planar carrier, applying of an electrically conductive material in the form of the connecting element, and the conductors and contact pins which are connected thereto, and detaching of the carrier from the flat part which is formed by way of the electrically conductive material. Here, the applying can take place in one or more layers, it being possible for individual ones of the plurality of layers to be connected to one another by way of process steps which are adapted to the respectively used material, for example drying, heating, cooling, cold welding, sintering and the like.

A method according to the second aspect for producing a double-row plug for a cable, the conductors of which lie in one plane next to one another, for example a ribbon or foil cable, comprises providing of one of the above-described flat parts, irrespective of the manner of its production.

In the case of a first variant, first bending of the conductors which are connected to the first side of the connecting element then follows in a first direction which points out of the plane of the flat part. In the case of the said variant, moreover, the conductors which are connected to the first side of the connecting element are subjected to a second bending operation, in the case of which they are bent in a second direction which is opposed to the first direction, with the result that the contact pins which are connected to the conductors lie in a plane which lies towards the plane of the flat part. Here, the sequence of the bending operations is unimportant. After the first and second bending operation which can also take place simultaneously, the conductors have a step, the contact pins of the conductors which are connected to the first and to the second side of the connecting element lying in parallel planes. If only the conductors which are connected on one side of the connecting element are bent in a step-shaped manner, the height of the step determines the spacing of the two rows of contact pins from one another. If the conductors which are connected on both sides of the connecting element are bent in each case in a step-shaped manner, the heights of the steps are to be adapted to one another, in order that a desired spacing of the two rows of contact pins from one another is ultimately set.

In the case of a second variant, the start is also first bending of the conductors which are connected to the first side of the connecting element in a first direction which points out of the plane of the flat part. Subsequently or at the same time, the conductors which are connected to the second side of the connecting element are bent in a second direction which points out of the plane of the flat part and is opposed to the first direction. Here, the spacings of the two bending points are selected in such a way that the contact pins of the first and second conductors are at a desired spacing from one another after the subsequent folding of the flat part.

Regardless of the variant, the bending operations are followed by a folding operation, in the case of which the connecting element and/or the first and/or second conductors are/is folded along a folding axis which runs transversely with respect to the direction, in which the first and second conductors extend from the connecting element, for example at a right angle with respect thereto. After the folding, the conductors which extend from the first side of the connecting element lie next to or between the conductors which extend from the second side of the connecting element in one plane, without making contact, however. The folding operation can be divided into three or four bending operations, the respective bending axes or bending edges of which run parallel to the first and second side of the connecting element, without one of the bending axes or bending edges dividing the connecting element symmetrically or it being necessary for one of the bending axes or bending edges to lie within the connecting element at all.

In the case of one refinement with three bending operations, two of the bending operations bend the connecting element and/or the conductors in the same bending direction, and the third bending operation bends the conductors which are connected to one side of the connecting element in the opposed bending direction. The conductors which are connected on the other side of the connecting element are not bent.

In the case of one refinement with four bending operations, two of the bending operations likewise bend the connecting element and/or the conductors in the same bending direction. The third and the fourth bending operation bend the conductors which emanate from the first and from the second side of the connecting element in each case in the opposed bending direction.

If the bending axes of one or two bending operations of the folding operation lie within the connecting element, the first and the second side of the connecting element approach one another; contact of the two sides at the end of the folding operation is not necessary.

After the bending and/or folding of the flat part, the three-dimensional structure which is produced in this way is overmoulded or encapsulated with an electrically insulating material. As soon as the electrically insulating material is present in a sufficiently dimensionally stable state, that is to say, for example, after cooling or curing, the connecting element is severed and the webs which connect in each case two adjacent contact pins are removed.

It is to be noted at this point that a parallel displacement of the contact pins of the parallel rows with respect to one another is dependent on whether the lines which lead to the contact pins already comprise a corresponding lateral offset for correction in the flat part. As a result, all bends can take place in each case along a common bending edge for all conductors which are connected to one side of the connecting element. Although bending of each individual one of the lines which emanate from one side in order to eliminate the parallel displacement would likewise be possible, it is much more complicated in technical terms. If the contact pins of the two parallel rows are to be offset with respect to one another, a correction of the offset is of course not required.

In the case of one or more refinements of the method, in accordance with the conductors which are connected to the first side, the conductors which are connected to the second side of the connecting element are bent in corresponding first and second bending operations, for example if an offset of all contact pins is desired with respect to a plane, in which the connection of the foil cable takes place after the bending and folding. Here, the offset can move the two rows of contact pins to the same side of the connector plane of the foil cable or can move in each case one row to one of the two sides.

In the case of one or more refinements of the method, the folded flat part is bent once or multiple times in a region, in which the conductors which are connected to the first and the second side of the connecting element lie in one plane. As a result, for example, a connector plane of the foil cable can run in a different direction to a direction, in which the contact pins point.

A plurality of the bending operations which are described above in relation to one or more refinements can be carried out at the same time and/or in another sequence; the designation of the bending operations by way of numeral variables does not presuppose a sequence or bending operations which follow one another temporally.

In one or more refinements, the overmoulding is followed by a separation of two parts of the body which is produced by way of the overmoulding, one of the two separated parts being mounted such that it can be moved in a connector region of the plug along the conductors which are severed from the connecting element. As a result, for example, a clamping bracket which can be displaced parallel to the conductors which lie in the connector plane or the connector region of the plug can be moulded in a single injection moulding operation onto the plug, by means of which clamping bracket a foil cable can be fixed in the plug and can be contacted electrically to the conductors. The separation can take place, for example, by way of cutting of connecting webs which connect the two parts after the overmoulding. The connecting webs can be cut by machine, for example, for instance at the time, at which the connecting element and the webs which connect in each case two adjacent conductors to one another are removed or interrupted. It is also possible, however, for the connecting webs to be of very thin configuration, with the result that they break off or tear and release the clamping bracket on account of a force which acts on the clamping bracket.

A double-row plug according to a third aspect of the invention comprises one of the above-described, folded and bent flat parts, or the parts thereof which remain in the body of the plug after the overmoulding and severing of the connecting element or the removal of the webs, and a body which is produced by way of overmoulding of the flat part.

In the case of one refinement, the plug has guide means in a connector plane, in which the lines which are connected to the contact pins lie, which guide means position conductors of a ribbon or foil cable which is provided with the plug with respect to the lines which are connected to the contact pins. The connection of the conductors of the ribbon or foil cable to the conductors of the plug can take place in a releasable manner by way of terminals or in a non-releasable manner by way of soldering or welding.

In the case of one variant of the refinement, the plug has a clamping means which is mounted such that it can be moved parallel to the conductors which are severed from the connecting element. After the introduction of the ribbon or foil cable, the clamping means is pushed from an open position into a clamped position, and fixes the ribbon or foil cable which is introduced into the plug. In the case of refinements of the said variant, the clamping means can press exposed electric contacts of the ribbon or foil cable onto conductors which are exposed in the connector region of the plug, and can thus establish an electric contact.

The contact pins of the plug can lie in a plane which is parallel to the plane of the ribbon or foil cable or is inclined with respect to the said plane. Here, the contact pins can point in the direction of the conductors of the ribbon or foil cable, or in a direction which points out of them, for example at a right angle with respect thereto.

Corresponding counter-contacts can be plugged onto the contact pins, in order to establish the electric connection to outgoing lines or electric devices.

An apparatus according to the invention for the transmission of current comprises at least one double-row plug according to the third aspect and a ribbon or foil cable which is connected to the plug in an electrically conducting manner.

In the case of one refinement, the ribbon or foil cable is present in a helically wound-up state.

In the case of another refinement, the ribbon or foil cable is present in a helically wound-up state in a bifilar winding.

A double-row plug for a ribbon or foil cable can be produced in a simple way by way of the flat part and the method according to the invention, by means of which double-row plug outgoing lines or electric devices can be connected in a simple way. It is advantageous here that the flat part is in one piece, and that an orientation and positioning of two separate contact parts before overmoulding is dispensed with. The single-piece flat part imparts a higher stability to the conductors and contacts during the overmoulding than might be achieved in the case of the use of separate parts. As a result, smaller conductor dimensions within the plug can also be used, since the webs which connect individual conductor pairs of the flat part to one another are removed or interrupted only after the overmoulding when the body has already fixed the conductors spatially.

In addition, the injection moulding die can be of simple design, and the overmoulding can take place in a single-stage injection moulding operation. Moreover, a reproducibly higher precision of the arrangement of the electric contacts can be achieved with the use of the flat part according to the invention.

BRIEF DESCRIPTION OF THE DRAWING

In the following text, the invention will be described in greater detail by way of example on the basis of one embodiment with reference to the appended figures. All the figures are purely diagrammatic and are not true to scale. In the figures.

Identical or similar elements are provided in the figures with identical or similar reference numerals.

DETAILED DESCRIPTION OF THE EXEMPLARY EMBODIMENTS

Figure 1:
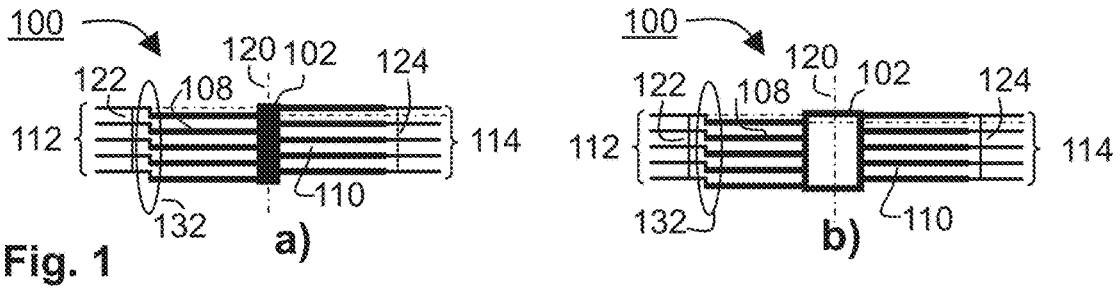
FIG. 1 shows a diagrammatic illustration of two versions of a first exemplary flat part according to the invention before reshaping.

FIG. 1 shows a diagrammatic illustration of two versions of a first exemplary flat part 100 according to the invention before reshaping. The flat part 100 has a connecting element 102, from the opposite sides of which first and second conductors 108, 110 extend. The difference between the flat parts which are shown in FIG. 1*a*) and FIG. 1*b*) consists merely in that the connecting element 102 in FIG. 1*a*) is formed by a strip, from which the conductors 108, 110 extend, whereas the connecting element 102 in FIG. 1*b*) is formed by a frame which encloses a free interior space. The two versions afford the same advantages, but the position of bending points can vary between the versions. The figure shows by way of example only one folding axis 120, along which or around which the flat part 100 is folded, in order to obtain a conductor part of a double-row plug.

In the case of the two versions, the first and second conductors 108, 110 open into first and second contact pins 112, 114 which are connected to webs 122, 124 in order to increase the stability during processing. The lateral offset of the conductors which lie opposite one another on the two sides of the connecting element is compensated for again by way of an offset section 132, with the result that the contact pins lie above one another again in the plug which is produced with the use of the flat part 100.

Figure 2:
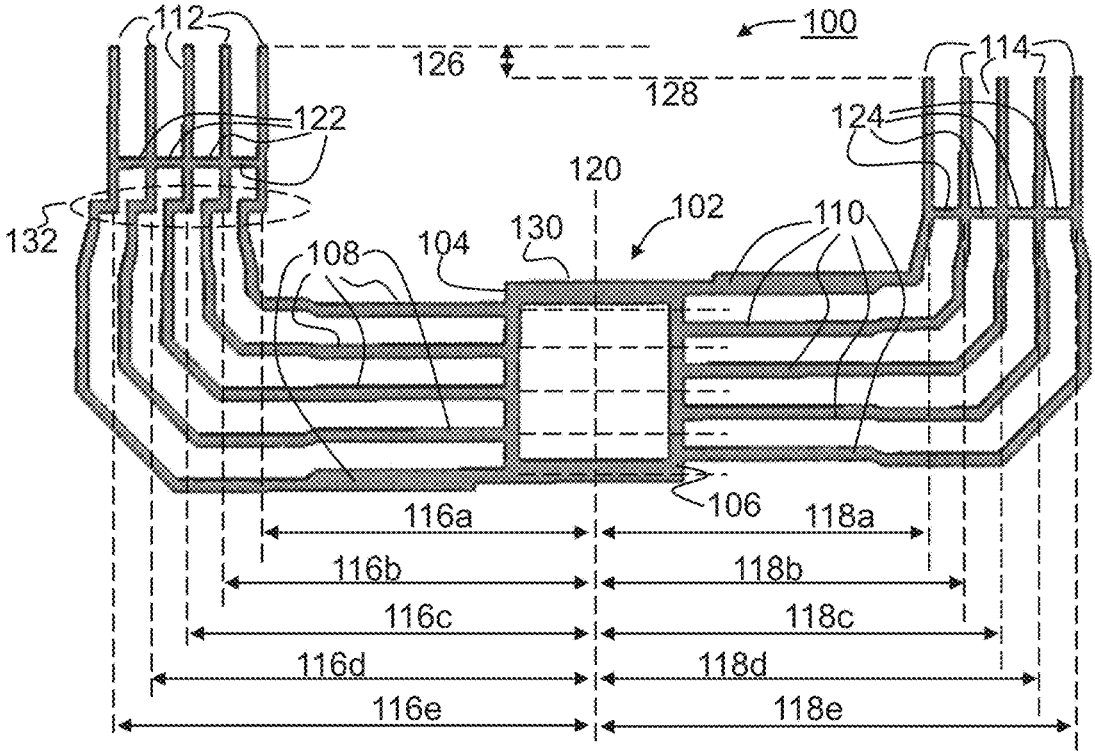
FIG. 2 shows a second exemplary flat part according to the invention for a double-row plug before reshaping.

FIG. 2 shows a second exemplary flat part 100 according to the invention for a double-row plug 200 before reshaping. The flat part 100 has a connecting element 102 with a first and a second side 104, 106, from which first conductors 108 and second conductors 110 extend. The ends of the first and second conductors 108, 110 form first and second contact pins 112, 114. The first and the second conductors 108, 110 are arranged offset on the opposite first and second sides 104, 106 of the connecting element 102 in such a way that the imaginary extension of a first conductor 108 runs beyond the connecting element 102 next to or between the connections of the second conductors 110 to the connecting element. This is indicated in the figure by way of the dashed lines which extend from the first conductors via the connecting element. The first contact pins 112 run from the respective first spacings 116*a*-116*e* from the connecting 102 at a first angle with respect to the direction, from which the first conductors 108 which are connected to them extend from the connecting element 102. The second contact pins 114 run from respective first spacings 118*a*-118*e* from the connecting element 102 at a second angle with respect to the direction, from which the second conductors 110 which are connected to them extend from the connecting element 102. The first and the second angle are mirror-inverted on an axis 120 which intersects the connecting element 102 symmetrically in the centre between the first and the second side 104, 106. In the example which is shown in the figure, the first and the second angle are right angles, but it is readily conceivable for other angles to be selected, depending on the requirements of the plug and its installation location.

In each case two adjacent first and second contact pins 112, 114 are connected to webs 122, 124 in a manner which is spaced apart from their ends. The webs 122, 124 increase the stability of the flat part in the case of following processing steps; they are removed in one of the last processing steps, just like the connecting element 102.

The contact pins 112 which are connected to the first side 104 of the connecting element 102 end at a greater spacing from a third side 130 of the connecting element 102 than the contact pins 114 which are connected to the second side 106. This is indicated in the figure by way of the auxiliary lines 126, 128 and the arrow which lies in between and indicates the difference. The different spacing of the ends of the first and second contact pins 112, 114 is due to the fact that at least the conductors which are arranged on one side of the connecting element have to be bent at two points in such a way that the contact pins lie in a plane which lies parallel to the plane of the connecting element, and therefore there are two parallel rows of contact pins after the processing steps, the ends of which lie in one plane. The step which results from the bends requires correspondingly longer conductor sections between the connecting element 102 and the contact pins.

Figure 3:
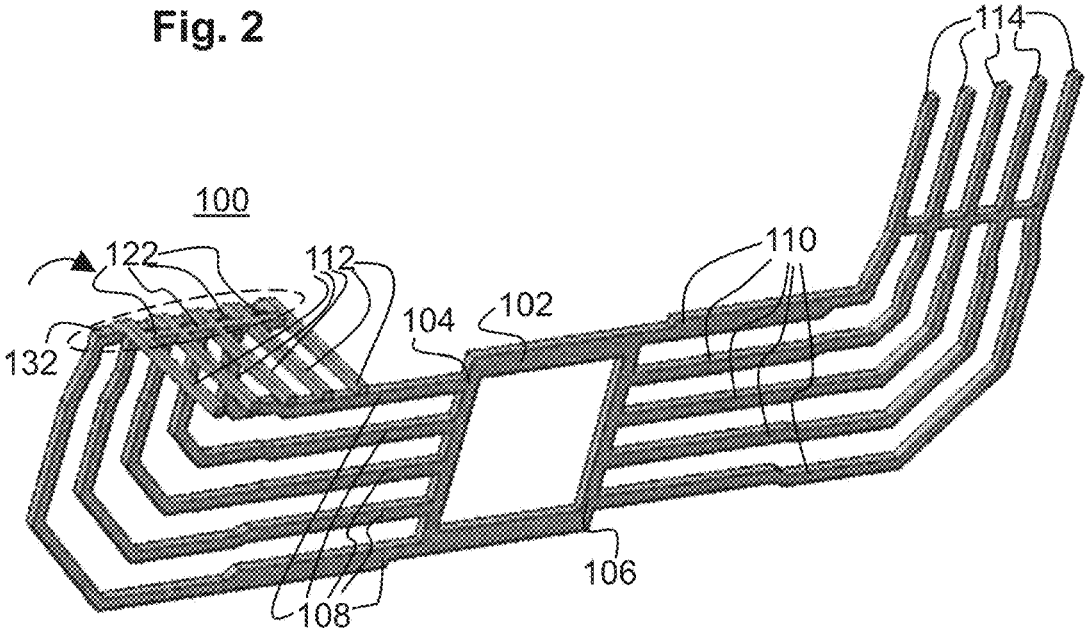
FIG. 3 shows a perspective illustration of the flat part from FIG. 2 after a first processing step of a method for producing a double-row plug.

FIG. 3 shows a perspective illustration of the flat part 100 from FIG. 2 after a first processing step 302 (FIG. 22) of a method 300 (FIG. 22) for producing a double-row plug 200. For the sake of improved clarity, only the elements which are relevant for understanding are provided with reference numerals in this figure and the following figures. In the first processing step, the first contact pins 112 are bent by 90° out of the plane of the flat part 100 in the case of a first bending operation, with the result that they then point obliquely downwards out of the plane of the drawing. In the case of the exemplary flat part which is shown in the figure, the bending point lies between the webs 122 and a section 132 of the first conductors 108 which are connected to the first side 104 of the connecting element 102, which section 132 compensates for the comb-like offset of the first and second conductors 108, 110 again after the folding of the connecting element 102, with the result that the first and the second contact pins 112, 114 are oriented in parallel rows with respect to one another. In the perspective which is shown in FIG. 3, the section 132 can be seen clearly only at the edge, and is therefore highlighted additionally by way of the dashed oval which is shown correspondingly in FIG. 1. The bending direction is indicated in this figure and the following figures by way of the arrow.

Figure 4:
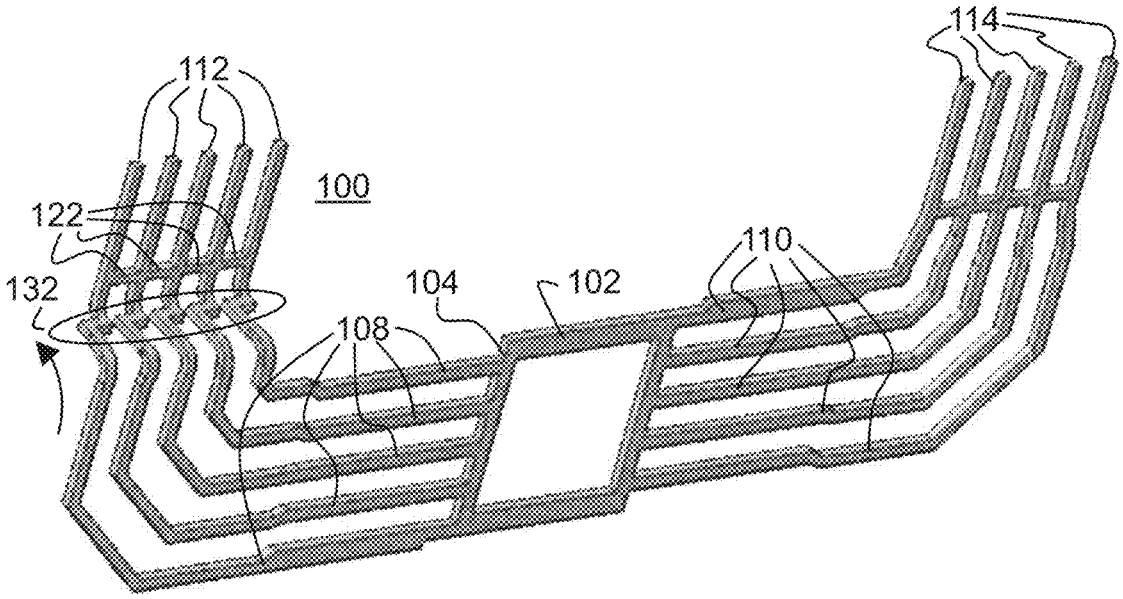
FIG. 4 shows a perspective illustration of the flat part from FIG. 2 after a second processing step of the method for producing a double-row plug.

FIG. 4 shows a perspective illustration of the flat part 100 from FIG. 2 after a second processing step 304 (FIG. 22) of the method 300 (FIG. 22) for producing a double-row plug 200. In this processing step, the conductors have been bent in a second bending operation 108 in a direction which is opposed to the first bend, with the result that the first contact pins 112 then run in a plane parallel to the plane of the flat part 100. In this figure, the conductor sections 132 can be also seen again, at which the contact pins 112 are offset laterally.

Figure 5:
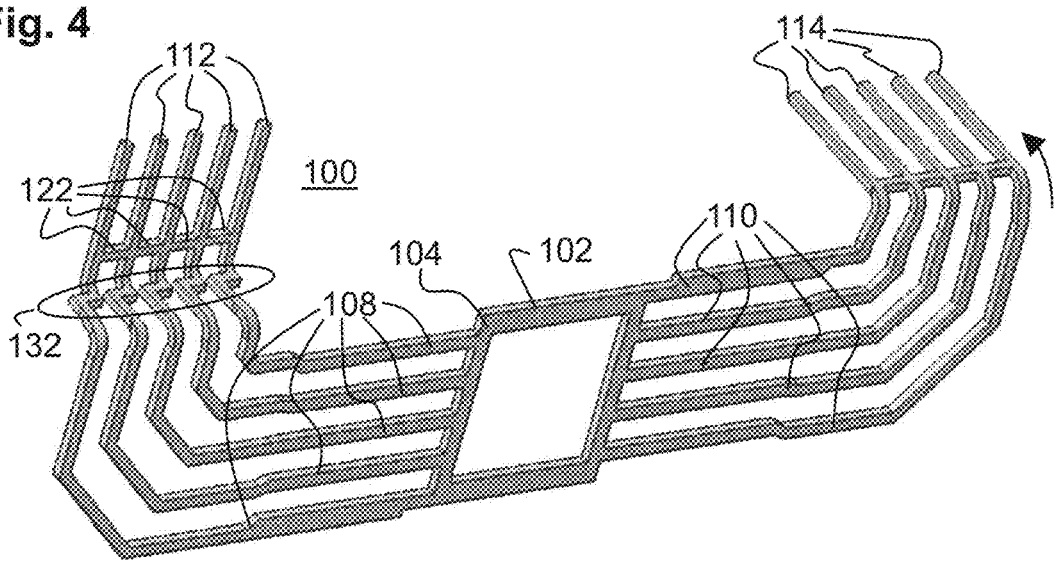
FIG. 5 shows a perspective illustration of the flat part from FIG. 2 after a third processing step of the method for producing a double-row plug.

FIG. 5 shows a perspective illustration of the flat part 100 from FIG. 2 after a third processing step 302*a* (FIG. 22) of the method 300 (FIG. 22) for producing a double-row plug 200. In the said processing step, the conductors 110 have been bent in a third bending operation in a direction which corresponds to the second bend, with the result that the second contact pins 114 point obliquely away from the observer into the plane of the drawing.

Figure 6:
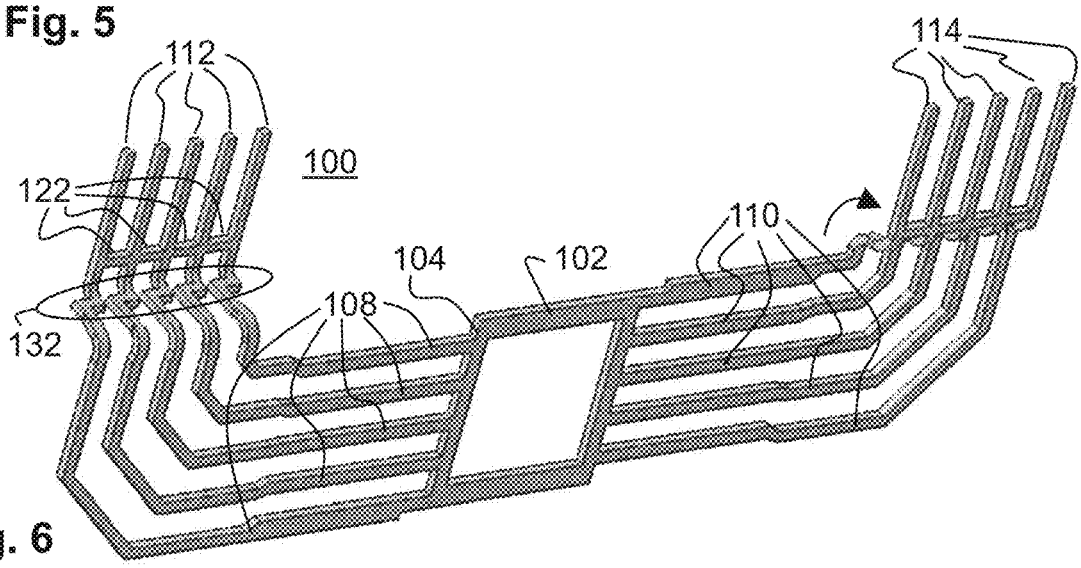
FIG. 6 shows a perspective illustration of the flat part from FIG. 2 after a fourth processing step of the method for producing a double-row plug.

FIG. 6 shows a perspective illustration of the flat part 100 from FIG. 2 after a fourth processing step 304*a* (FIG. 22) of the method 300 (FIG. 22) for producing a double-row plug 200. In the said processing step, the conductors 110 have been bent in a fourth bending operation in a direction which corresponds to the first bend, with the result that the second contact pins 114 then run in a plane parallel to the plane of the flat part 100.

Figure 7:
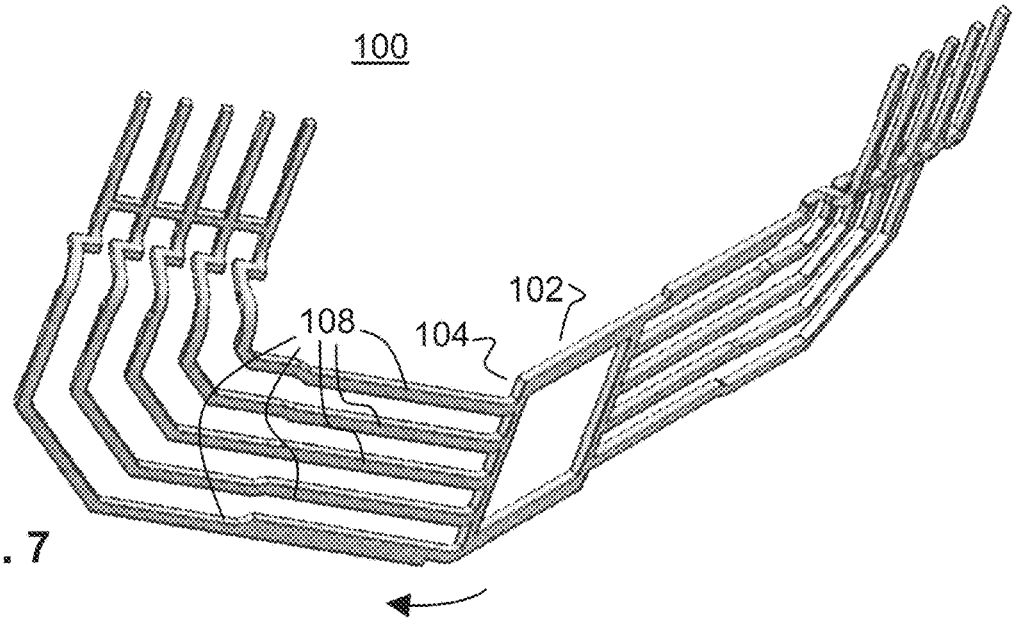
FIG. 7 shows a perspective illustration of the flat part from FIG. 2 after a first part step of a fifth processing step of the method for producing a double-row plug.

FIG. 7 shows a perspective illustration of the flat part 100 from FIG. 2 after a first part step of a fifth processing step 306 (FIG. 22) of the method 300 (FIG. 22) for producing a double-row plug 200. In the said processing step, which represents a first step of the folding of the connecting element 102, the first conductors 108 on the first side 104 of the connecting element 102 are bent away from the observer into the plane of the drawing.

Figure 8:
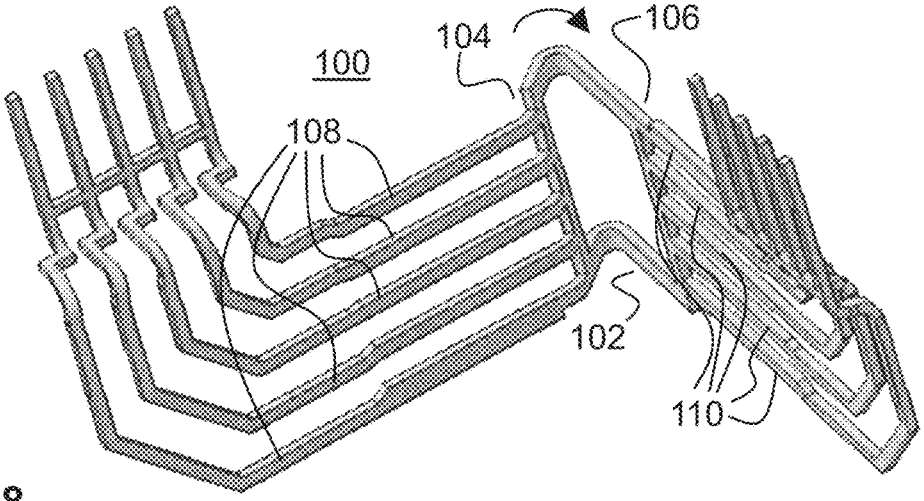
FIG. 8 shows a perspective illustration of the flat part from FIG. 2 after a second part step of the fifth processing step of the method for producing a double-row plug.

FIG. 8 shows a perspective illustration of the flat part 100 from FIG. 2 after a second part step of the fifth processing step 306 (FIG. 22) of the method 300 (FIG. 22) for producing a double-row plug 200. In the said processing step, which represents a second step of the folding of the connecting element 102, the connecting element 102 is bent in a direction which lies counter to the direction of the bend of the first step of the folding. Here, the connecting element 102 is bent at the connecting webs between the first side 104 and the second side 106, with the result that the first conductors 108 and the second conductors 110 run in planes which lie approximately perpendicularly with respect to one another.

Figure 9:
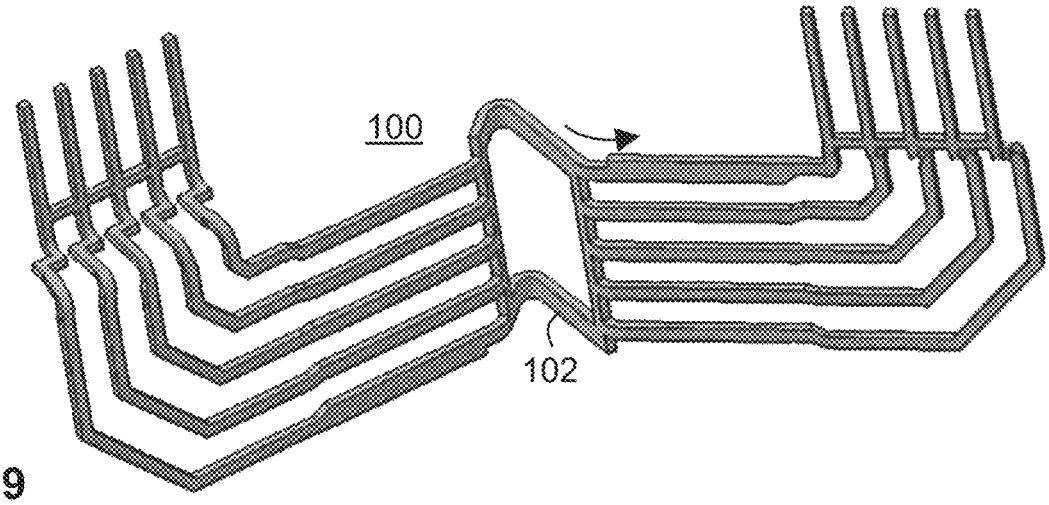
FIG. 9 shows a perspective illustration of the flat part from FIG. 2 after a third part step of the fifth processing step of the method for producing a double-row plug.

FIG. 9 shows a perspective illustration of the flat part 100 from FIG. 2 after a third part step of the fifth processing step 306 (FIG. 22) of the method 300 (FIG. 22) for producing a double-row plug 200. In the said processing step, which represents a third step of the folding of the connecting element 102, the second conductors 110 are bent away from the observer towards the plane of the drawing.

Figure 10:
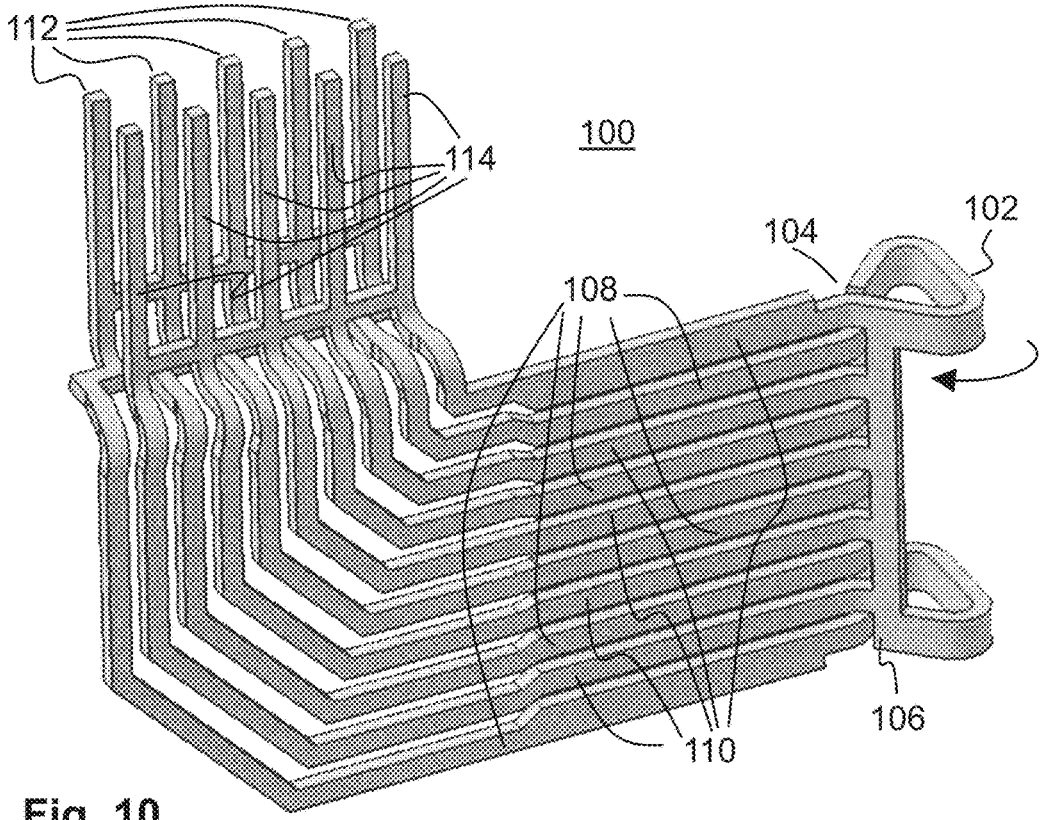
FIG. 10 shows a perspective illustration of the flat part from FIG. 2 after a fourth part step of the fifth processing step of the method for producing a double-row plug.

FIG. 10 shows a perspective illustration of the flat part 100 from FIG. 2 after a fourth part step of the fifth processing step 306 (FIG. 22) of the method 300 (FIG. 22) for producing a double-row plug 200. In the said processing step, which represents a fourth step of the folding of the connecting element 102, the connecting element 102 is finally bent in such a way that the first side 104 and the second side 106 of the connecting element 102 approach one another, and the first conductors 108 and the second conductors 110 lie in an alternating manner next to one another in one plane. It can already be seen clearly in the figure that the first and second contact pins 112, 114 are arranged in two parallel rows with respect to one another.

Figure 11:
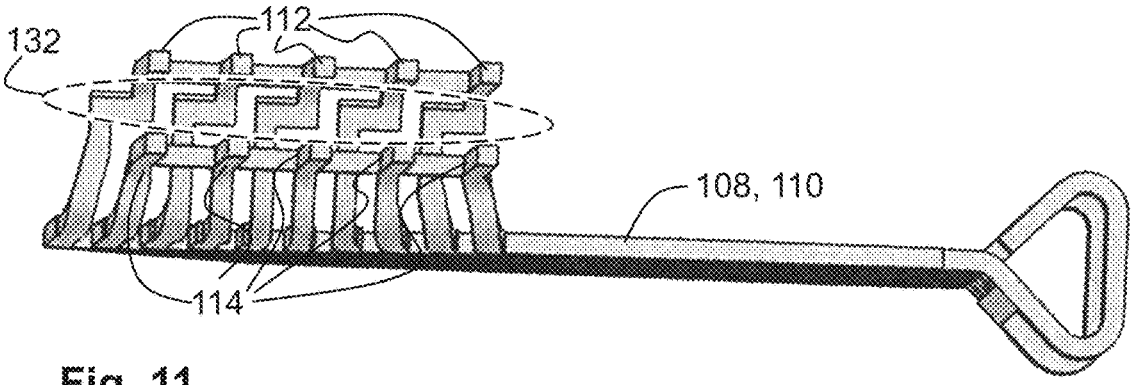
FIG. 11 shows an illustration of the flat part from FIG. 10 from another perspective.

FIG. 11 shows an illustration of the flat part 100 from FIG. 10 from another perspective. It can be seen clearly in the said view that the first and the second conductors 108, 110 lie in one plane, and that the first contact pins 112 and the second contact pins 114 are arranged above one another in two parallel planes. It can likewise be seen clearly in the said figure how the conductor section 132 of the first conductors 108 offsets the first contact pins 112 laterally in such a way that they are arranged in each case exactly above second contact pins 114.

Figure 12:
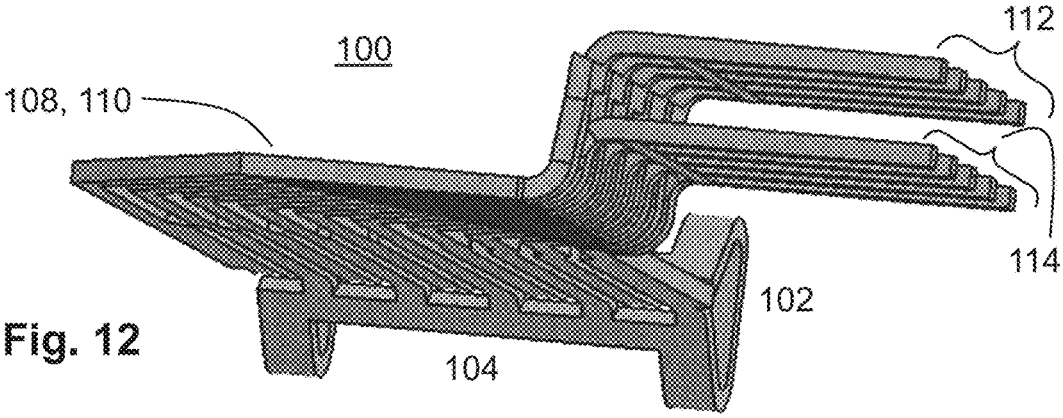
FIG. 12 shows an illustration of the flat part from FIG. 10 from a further perspective.

FIG. 12 shows an illustration of the flat part 100 from FIG. 10 from a further perspective. It can also be seen in the said view that the first and the second conductors 108, 110 lie in one plane, and that the first contact pins 112 and second contact pins 114 are arranged above one another in two parallel planes.

Figure 13:
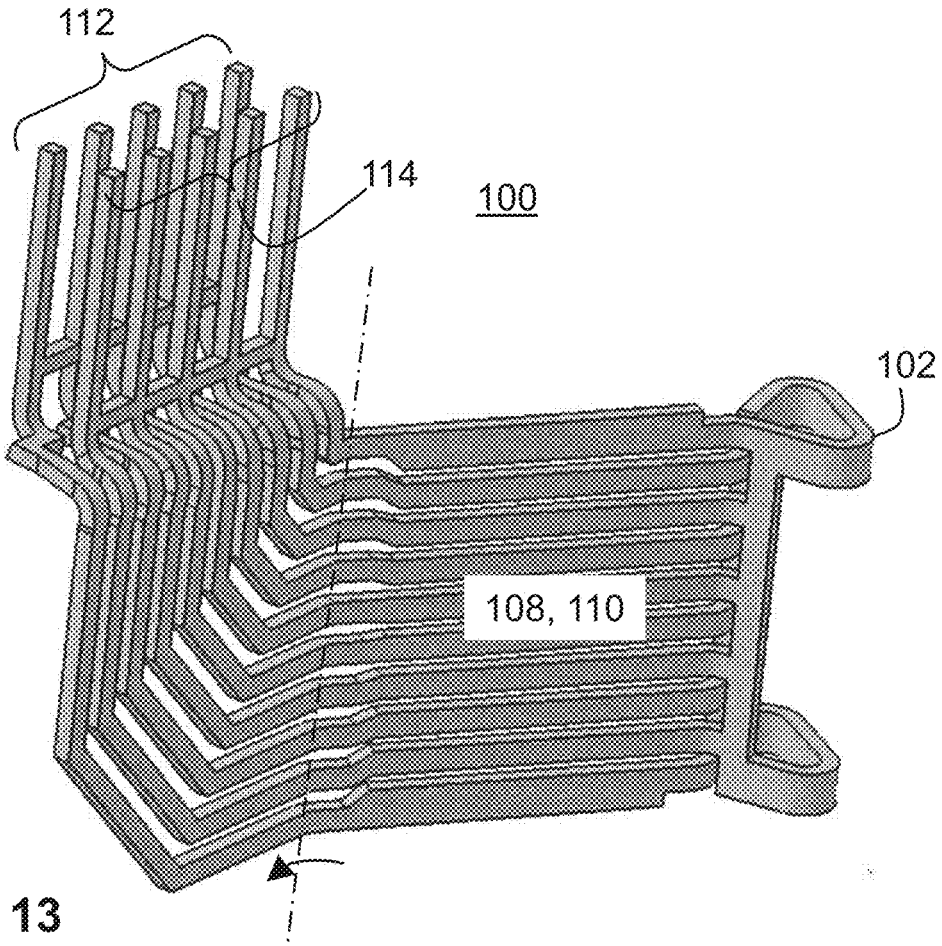
FIG. 13 shows a perspective illustration of the flat part from FIG. 2 after a sixth processing step of the method for producing a double row plug.

FIG. 13 shows a perspective illustration of the flat part 100 from FIG. 2 after a sixth processing step 312 (FIG. 22) of the method 300 (FIG. 22) for producing a double-row plug 200. In the said processing step, the flat part 100 is bent out of the plane of the drawing towards the observer in the region, in which the first conductors 108 and the second conductors 110 lie in an alternating manner next to one another in one plane, with the result that the two parallel rows of contact pins 112, 114 no longer run in planes which lie parallel to the plane, in which the first conductors 108 and second conductors 110 extend from the connecting element 102. The dash-dotted line indicates the axis, along which the bend has taken place.

Figure 14:
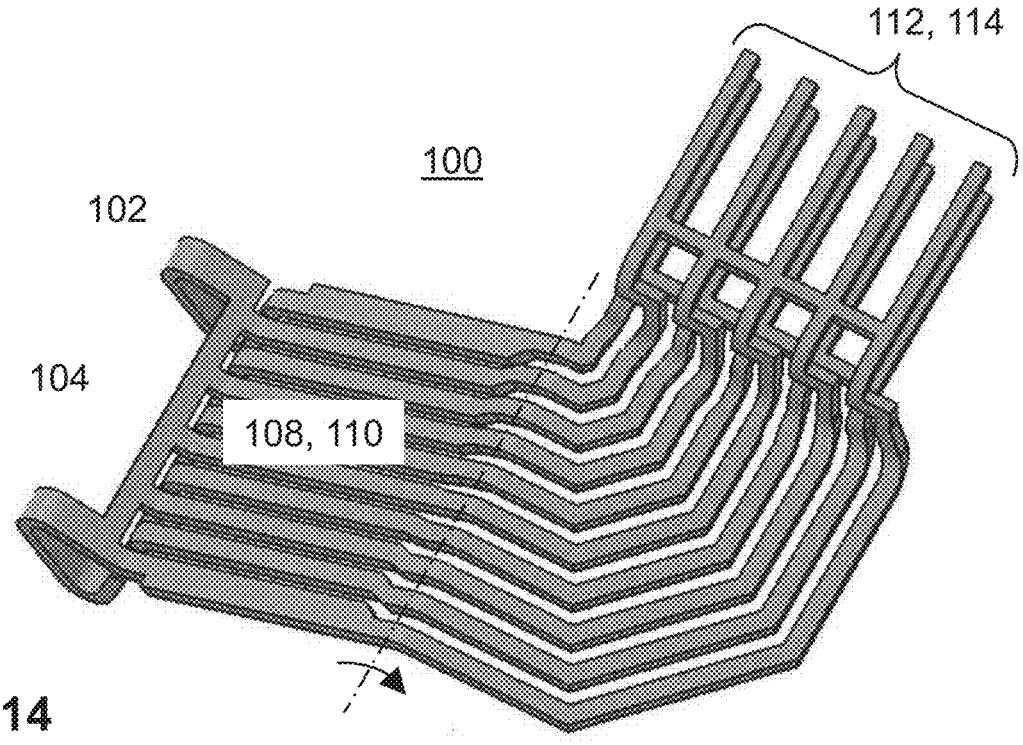
FIG. 14 shows an illustration of the flat part from FIG. 13 from another perspective.

FIG. 14 shows an illustration of the flat part 100 from FIG. 13 from another perspective. In the said illustration, that part with the first and second contact pins 112, 114 which is bent out of the plane of the first and second conductors 108, 110 is bent away from the observer. As in FIG. 13, the dash-dotted line indicates the axis, along which the bend has taken place.

Figure 15:
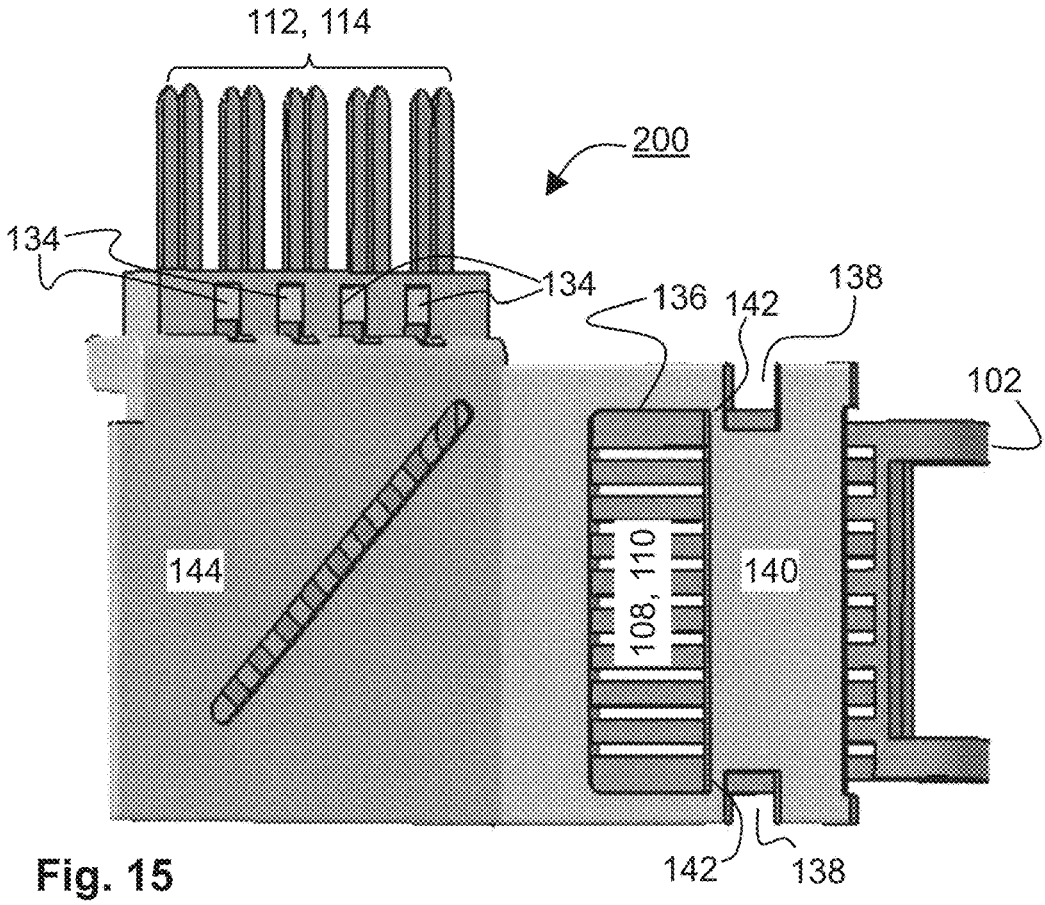
FIG. 15 shows a perspective illustration of the flat part from FIG. 2 after a seventh processing step of the method for producing a double-row plug.

FIG. 15 shows a perspective illustration of the flat part 100 from FIG. 2 after a seventh processing step 308 of the method 300 for producing a double-row plug 200. In the said processing step, the flat part from FIG. 12 is overmoulded with an electrically non-conducting material, for example plastic. Here, the first and second contact pins 112, 114 and the connecting element 102 have remained exposed, just like windows 134 between the contact pins, one window 136 in the region, in which the first and second conductors 108, 110 lie in an alternating manner next to one another in one plane, and two notches 138 next to the first and second conductors 108, 110. A guiding or clamping part 140 is connected merely by way of two narrow connecting webs 142 to the body 144 of the plug 200.

Figure 16:
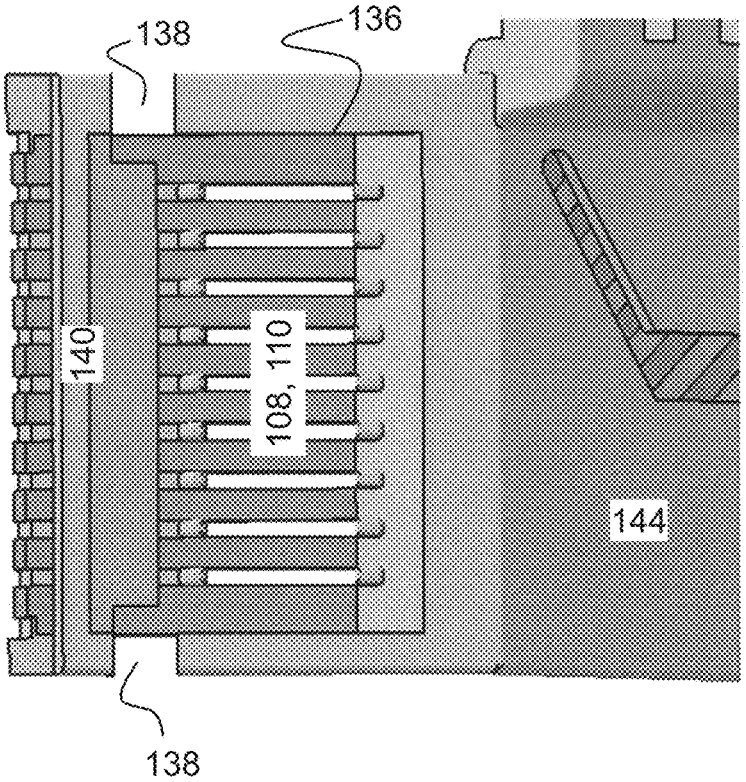
FIG. 16 shows a perspective illustration of a detail of the plug which is produced with use of the flat part from FIG. 2, after an eighth processing step of the method.
Figure 22:
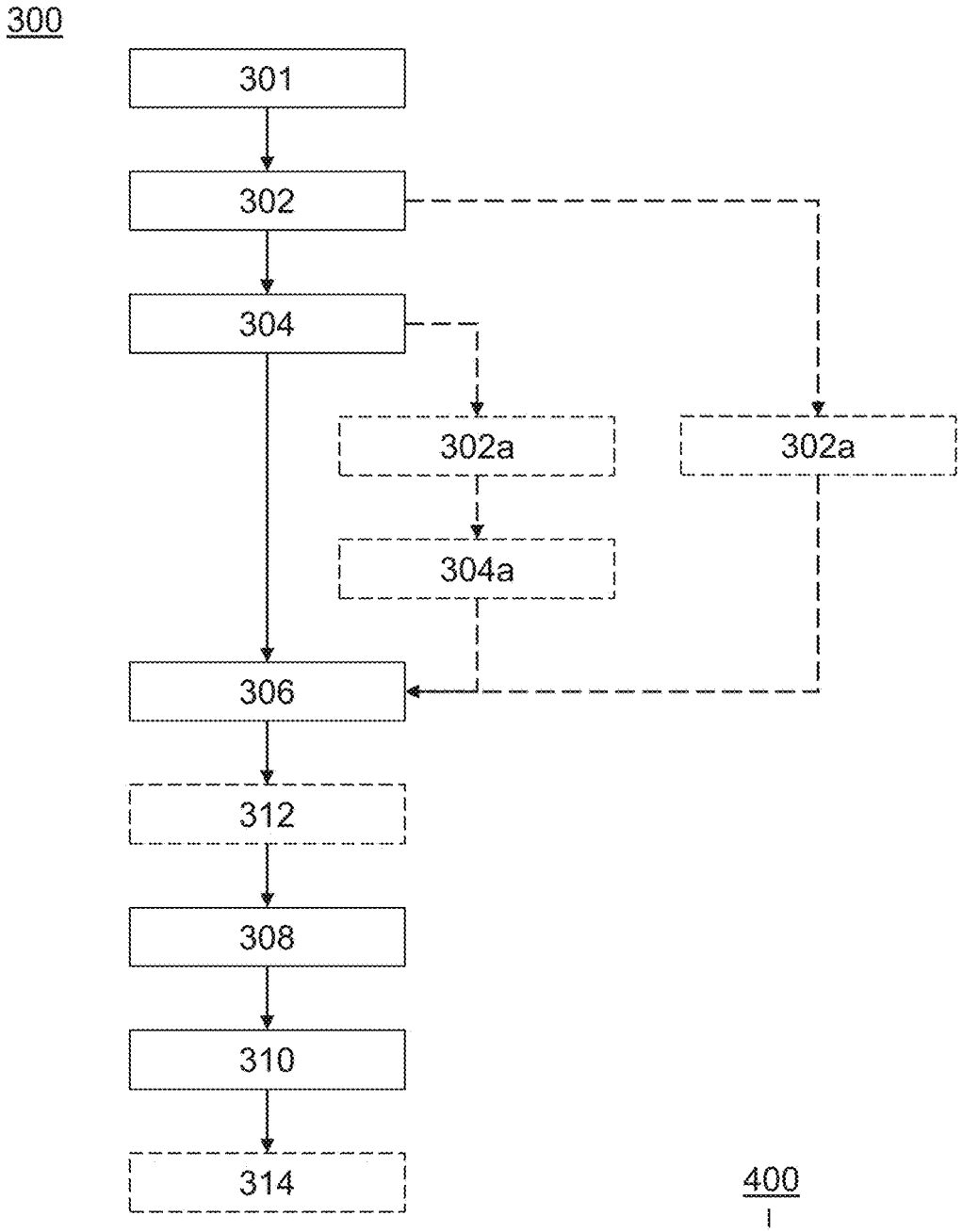
FIG. 22 shows a diagrammatic flow chart of the method according to the invention for producing a double-row plug with use of a flat part according to the invention.

FIG. 16 shows a perspective illustration of a detail of the plug 200 which is produced with the use of the flat part 100 from FIG. 2, after an eighth processing step 310 (FIG. 22) of the method 300 (FIG. 22). In the said processing step, the connecting element 102 has been severed from the first and second conductors 108, 110. A foil cable (not shown in the figure) can be pushed into the plugs between the guiding or clamping part 140 and the first and second conductors 108, 110, the conductor tracks of which foil cable correspond with the first and second conductors 108, 110. The conductor tracks of the foil cable can be connected electrically to the first and second conductors 108, 110, for example by way of soldering or welding. An electric connection between the conductor tracks of the foil cable and the first and second conductors 108, 110 can also be established by way of being pressed against one another. The detail which is shown in FIG. 15 is shown as viewed from the rear side which is not visible in FIG. 14.

Figure 17:
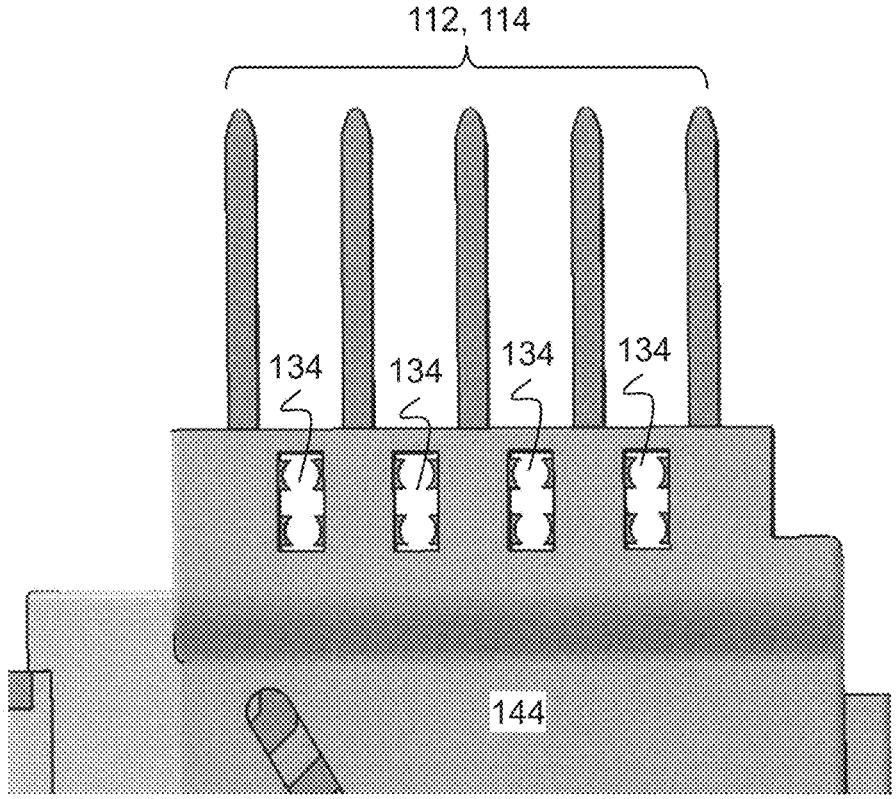
FIG. 17 shows a perspective illustration of another detail of the plug which is produced with use of the flat part from FIG. 2, after the eighth processing step of the method.

FIG. 17 shows an illustration of another detail of the plug 200 which is produced with the use of the flat part 100 from FIG. 2, after the eighth processing step 310 (FIG. 22) of the method 300 (FIG. 22). It can be seen in the said detail how the webs which lie between adjacent contact pins are interrupted through the windows 134, with the result that the contact pins are then no longer connected electrically to one another. The webs can be interrupted, for example, by way of punching tools which are guided through the windows 134 of the body 144.

Figure 18:
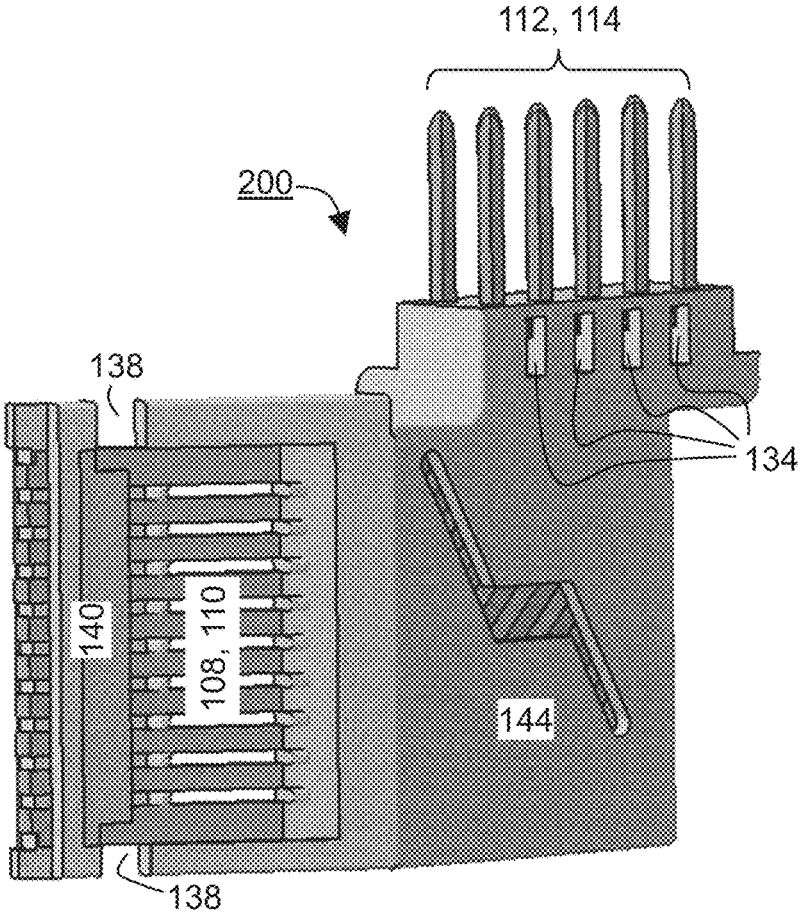
FIG. 18 shows an illustration of the plug which is produced with use of the flat part from FIG. 2, from a first perspective.

FIG. 18 shows an illustration of the plug 200 which is produced with use of the flat part from FIG. 2, from a first perspective. It can be seen clearly in the said illustration how the contact pins run parallel to a plane which is tilted slightly with respect to the conductors 108, 110.

Figure 19:
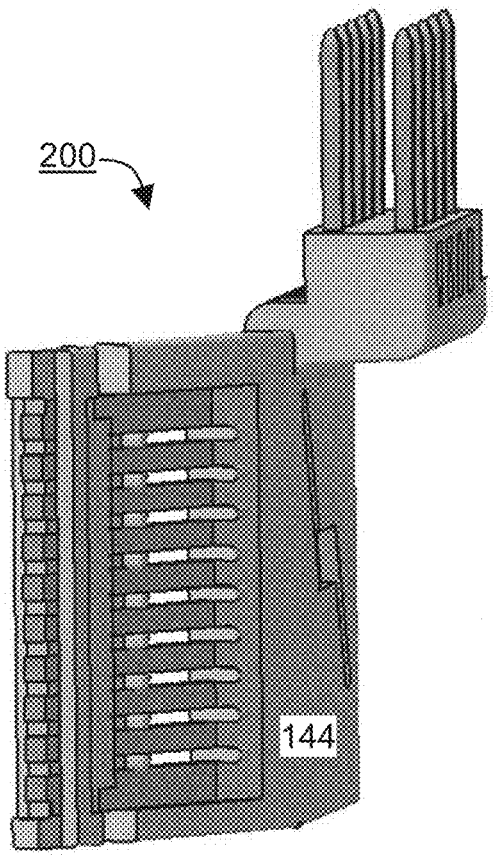
FIG. 19-21 show illustrations of the plug from further perspectives.
Figure 20:
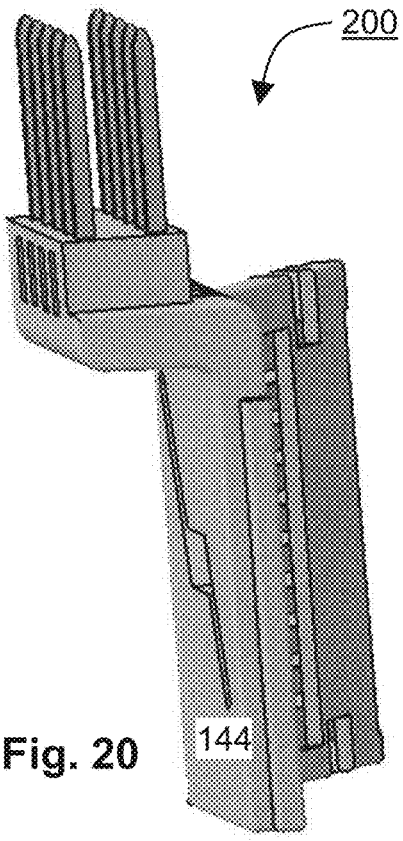
Figure 21:
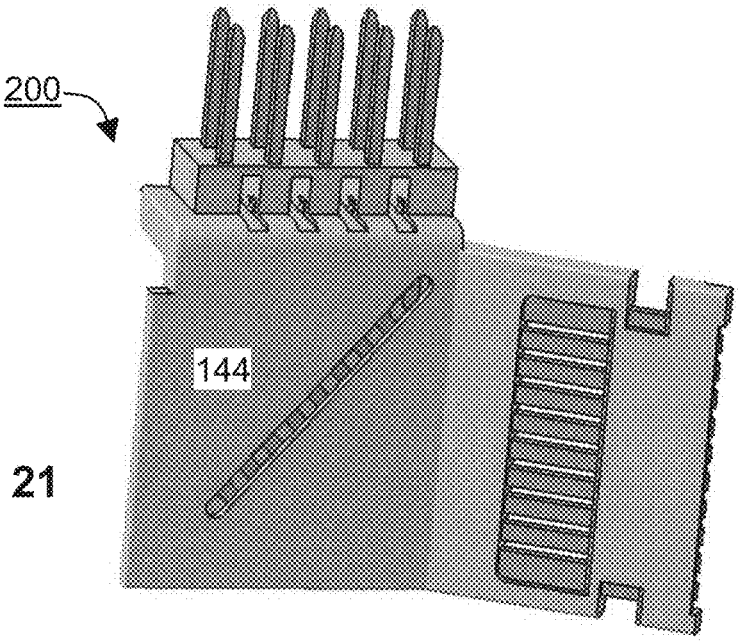

FIGS. 19 to 21 show illustrations of the plug 200 from further perspectives.

FIGS. 2 to 15 show the connecting element 102 as a substantially rectangular part with four sides which enclose a free interior space. It is likewise possible for the connecting element to be configured, as shown in FIG. 1*a*), merely as a strip which connects the conductors 108, 110 without a free interior space, the first side 104 and the second side 106 then lying on two sides of the same strip. In this case, the bending operations which are carried out within the connecting element 102 during the folding would take place in the region of the conductors 108, 110. The first conductors 108 and/or the second conductors 110 are then expediently of correspondingly longer configuration.

FIG. 22 shows a diagrammatic flow chart of a method 300 according to the invention for producing a double-row plug 200 with use of a flat part 100 according to the invention. The individual method steps have already been described in detail with reference to FIGS. 1 to 15, with the result that merely a brief summary takes place at this point. In step 301, the flat part 100 according to the invention is first of all provided. Subsequently, in step 302, at least the conductors 108 which are connected to the first side 104 of the connecting element 102 are bent in a first bending operation at a third spacing from the connecting element 102 in a first direction which points out of the plane of the flat part 100.

In step 304, in a second bending operation, at least the conductors 108 which are connected to the first side 104 of the connecting element 102 are bent at a fourth spacing from the connecting element 102 in a direction which is opposed to the first bending direction, with the result that first contact pins 112 of the first conductors 108 lie in a second direction which points parallel to the plane of the flat part 100. The distance between the third and the fourth spacing determines a height of the step which is produced by way of the two bending operations, and ultimately determines, as a result, the spacing of the parallel rows of contact pins of the plug which is produced according to the present method.

Depending on the shape requirements of the plug, it is possible for only the conductors which are connected to one side of the connecting element 102 to be bent into a step-shaped profile, and for the conductors which are connected to the other side of the connecting element to be left straight. It is also possible, however, for the conductors on both sides of the connecting element 102 to be bent in each case into a step-shaped profile. A lateral offset of the contact pins 112, 114 can then be set with respect to a plane, in which the conductors 108, 110 extend from the connecting element. In each case one row of contact pins can then lie on one side of the plane, or both rows of contact pins can lie on the same side of the plane. The optional additional bending operations of the conductors which are connected on the other side of the connecting element 102 are shown in the figure as steps 302*a*, 304*a* with a dashed border.

It is likewise possible to allow the contact pins to point out of the plane of the flat part with only in each case one bend, for example at a right angle with respect to the said plane of the flat part. In this case, the first conductors would be bent only in a first bending operation 302, and the second conductors would be bent correspondingly in a first bending operation 302*a*. The optional bending operation of the second conductors is shown in the figure as step 302*a* with a dashed border.

In step 306, the connecting element 102 is then folded along a folding axis 120 which intersects the connecting element symmetrically in the centre between the first and the second side, with the result that the first and the second side 104, 106 of the connecting element 102 approach one another, and the first conductors 108 which extend from the first side 104 of the connecting element 102 lie in one plane next to or between the second conductors 110 which extend from the second side 106 of the connecting element 102, without coming into contact with one another. Here, the folding can comprise a plurality of separate bending operations along different bending axes which lie symmetrically or asymmetrically with respect to the folding axis 120.

In step 308, the overmoulding of the folded flat part 100 with an electrically insulating material follows.

In step 310, the connecting element 102 is severed, and the webs 122, 124 are removed or cut through.

In an optional step 312 which lies before the overmoulding, the folded flat part 100 can be subjected to one or more bending operations in a region, in which the conductors 108, 110 which are connected to the first and the second side 104, 106 of the connecting element 102 lie in one plane. As a result, the contact pins can point in a direction which points out of the direction of the plane, in which the conductors 108, 110 which are connected to the first and the second side 104, 106 of the connecting element 102 lie.

In a concluding optional step 314, a part 140 of the body 144 which is produced by way of overmoulding of the folded flat part 100 is separated from the said body 144. The separated part 140 is mounted such that it can be displaced longitudinally in a connection region of the plug 200 along the conductors 108, 110 which are severed from the connecting element 102, and can form, for example, a clamping part, by means of which the ribbon or foil cable can be connected to the plug 200.

Figure 23:
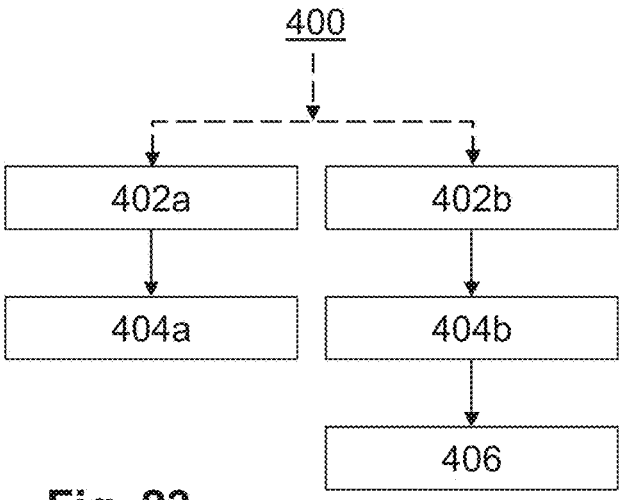
FIG. 23 shows a diagrammatic flow diagram of a method for producing a flat part according to the invention.

FIG. 23 shows a diagrammatic flow chart of a method 400 for producing a flat part 100 according to the invention. The arrangement of the conductors 108, 110, the contact pins 112, 114 and the connecting element 102 has been fixed previously in accordance with the requirements of the plug.

In a first variant of the method, in step 402*a*, a plate or a sheet made from an electrically conductive material is provided, which is punched in the following step 402*b* by way of a punching die which correspondingly reproduces the previously fixed arrangement of the conductors, the contact pins and the connecting element with respect to one another.

In a second variant of the method, in step 402*b*, a planar carrier is provided, onto which, in step 404*b*, an electrically conductive material is applied in one or more layers in the previously fixed shape of the flat part. In step 406, the carrier is then released from the flat part which is formed by way of the applied electrically conductive material.

Figure 24:
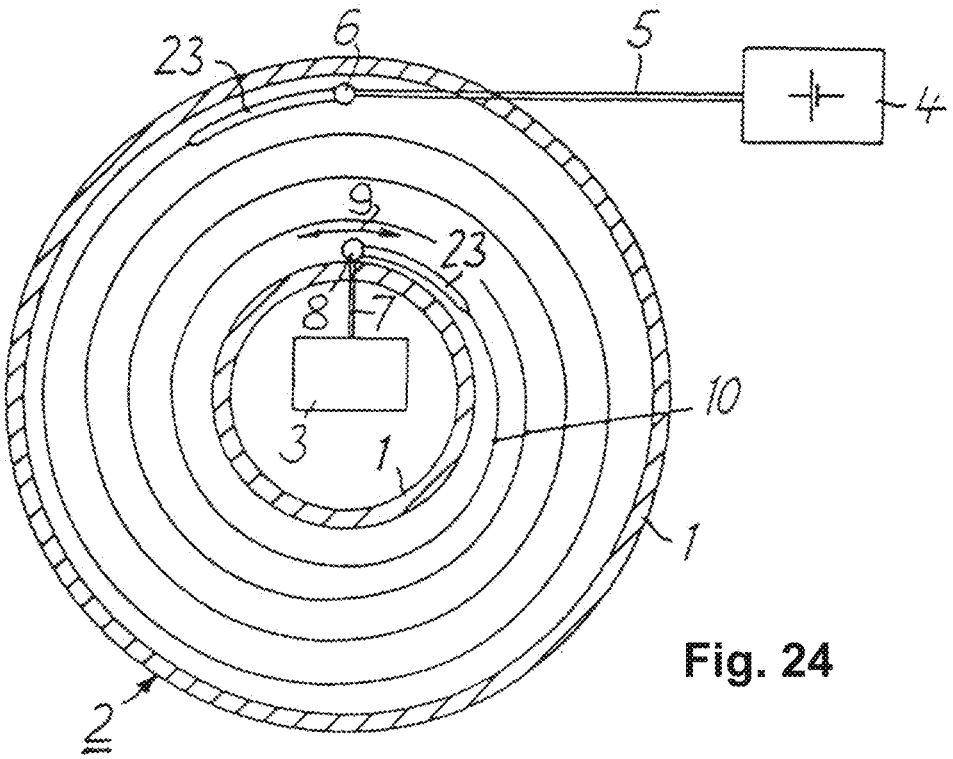
FIG. 24 shows a first diagrammatic illustration of an application of an apparatus according to the invention for the transmission of current with a ribbon or foil cable and one or two plugs which are produced with use of the flat part according to the invention.

FIG. 24 shows a first diagrammatic illustration of an application of an apparatus according to the invention for the transmission of current with a ribbon or foil cable and one or two plugs 200 produced with use of the flat part 100 according to the invention. The figure diagrammatically shows two walls 1 of circular configuration of a housing 2 of an electric device. The said device can be, for example, a control unit which is installed into the steering wheel of a motor vehicle. For the supply of current to electronics 3 of the device, the latter is connected to the battery 4 of the motor vehicle. The battery 4 is connected via an electric line 5 to a terminal 6 which is configured as a fixed point. The electronics 3 are connected via an electric line 7 to a terminal 8 which can be moved in the direction of the double arrow 9. A ribbon or foil cable 10 with a plurality of conductors is connected between the two terminals 6 and 8. The lines 5 and 7 are "outgoing lines" and are to be connected to the ribbon or foil cable 10.

According to FIG. 24, the ribbon or foil cable 10 can be arranged in a plurality of windings between the two terminals 6 and 8, that is to say in the manner of a spring barrel of clocks. Although the number of revolutions of a steering wheel is limited to a few revolutions, a greater number of windings can be provided for the ribbon or foil cable 10. The rotational movement of the terminal 8 does not then have a substantial impact on an individual winding of the ribbon or foil cable 10. Merely the diameter of the roll which consists of all the windings of the ribbon or foil cable 10 is decreased or increased. The ribbon or foil cable 10 is preferably equipped with flat conductors. The said embodiment of the ribbon or foil cable 10 is particularly thin and therefore takes up very little space. The ribbon or foil cable 10 might also fundamentally have round conductors, however.

In the case of one variant which is not shown in the figure, the ribbon or foil cable changes direction approximately in the middle, and is arranged helically between the walls of the housing as a part which leads to and fro. In the case of a rotation of the terminal, the point, at which the direction changes, is moved accordingly. In other words, the outwardly running section runs on the inner wall in the case of a rotation, with the result that the reversal point moves. An arrangement of this type is also called a U-turn clock spring.

Figure 25:
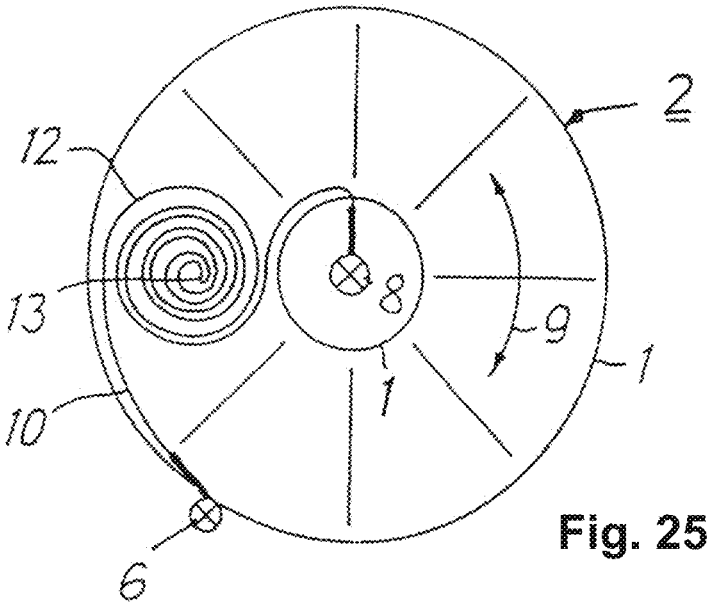
FIG. 25 shows a second diagrammatic illustration of an application of an apparatus according to the invention for the transmission of current with a ribbon or foil cable and one or two plugs which are produced with use of the flat part according to the invention.

As shown in FIG. 25, the ribbon or foil cable 10 can also be wound as a bifilar coil 12 between the two terminals 6 and 8. In the bifilar coil 12, the ribbon or foil cable 10 is bent over approximately in its centre, which results in a reversal point 13. From there, the ribbon or foil cable 10 is wound in two layers. The diameter of the bifilar coil 6 in the starting position of the apparatus is expediently selected in such a way that it is equal to the shortest spacing of the two terminals 6 and 8 from one another or is smaller than the said spacing.

In the case of the two apparatuses for the transmission of current which are shown in the figures, the ribbon or foil cable is provided at at least one of the two terminals 6 and 8 with a plug 200 according to the invention, in order to make the connection possible to outgoing cables or lines or to electric devices.

| List of Reference Numerals | |
|---|---|
| 1 | Wall |
| 2 | Housing |
| 3 | Electronics |
| 4 | Battery |
| 5 | Electric line |
| 6 | Terminal |
| 7 | Electric line |
| 8 | Terminal |
| 9 | Double arrow |
| 10 | Ribbon or foil cable |
| 12 | Bifilar coil |

-continued

| List of Reference Numerals | |
|---|---|
| 13 | Reversal point |
| 100 | Flat part |
| 102 | Connecting element |
| 104 | First side |
| 106 | Second side |
| 108 | First conductors |
| 110 | Second conductors |
| 112 | First contact pins |
| 114 | Second contact pins |
| 116a-116e | First spacings |
| 118a-118e | Second spacings |
| 120 | Axis |
| 122 | Web |
| 124 | Web |
| 126 | Auxiliary line |
| 128 | Auxiliary line |
| 130 | Third side |
| 132 | Offset section |
| 134 | Window |
| 136 | Window |
| 138 | Notch |
| 140 | Guiding or clamping part |
| 142 | Connecting web |
| 144 | Body |
| 200 | Plug |
| 300 | Method |
| 301-314 | Method steps |
| 400 | Method |
| 402-406 | Method steps |

The invention claimed is:

1. Electrically conductive, single-piece flat part for a plug with first and second contact pins which are arranged in two parallel rows, and with a connector region for a cable, the conductors of which lie in one plane next to one another, said single-piece flat part comprising:

a connecting element (102) with a second side (106) which lies opposite the first side (104), conductors (108, 110) which open into the first and second contact pins (112, 114) extending from the first and from the second side of the connecting element, the conductors (108, 110) which lie on the opposite sides of the connecting element (102) being connected to the connecting element (102) in a manner which is offset with respect to one another in such a way that the imaginary straight extension of a conductor (108, 110) runs on the one side of the connecting element (102) next to one or between two conductors (108, 110) on the opposite side of the connecting element (102), the first contact pins (112) being connected via an offset region (132) to the first conductors (108) which extend from the first side of the connecting element (102), which offset region (132) compensates for the offset of the first and second conductors (108, 110) on the connecting element (102).

2. The flat part according to claim 1, wherein, in each case two adjacent contact pins which are connected to the same side of the connecting element being connected to one another in a manner which is spaced apart from their ends by way of webs.

3. The flat part according to claim 1, wherein the contact pins which are connected to the first side of the connecting element running in each case at first spacings from the connecting element at a first angle with respect to the direction, from which the conductors which are connected to them extend from the connecting element, and the contact pins which are connected to the second side of the connecting element running in each case at second spacings from the connecting element at a second angle with respect to the direction, from which the conductors which are connected to them extend from the connecting element, the first and the second angle being mirror-inverted at a folding axis which runs transversely with respect to a direction, in which the first and second conductors extend from the connecting element.

4. The flat part according to claim 3, wherein the contact pins which are connected to the first side of the connecting element ending at a greater spacing from a third side of the connecting element, which third side connects the first and the second side (104, 106), than the contact pins which are connected to the second side (106) of the connecting element.

5. A method for producing a flat part according to claim 1, comprising:

providing of a plate or a sheet made from an electrically conductive material (metal, alloy, plastic), and punching of the flat part, or providing of a planar carrier, applying of an electrically conductive material in the form of the flat part in one or more layers to the carrier, and detaching of the carrier from the flat part which is formed by way of the electrically conductive material.

6. A method for producing a double-row plug with a connector region for a cable, the conductors of which lie in one plane next to one another, with the use of a flat part according to claim 1, comprising:

providing of the flat part, the method comprising, in a first variant:

first bending of the first conductors which are connected to the first side of the connecting element in a first direction which points out of the plane of the flat part, second bending of the first conductors which are connected to the first side of the connecting element in a direction which is opposed to the first bending direction, with the result that first contact pins of the first conductors lie in a second direction which points parallel to the plane of the flat part, the method comprising, in a second variant:

first bending of the first conductors which are connected to the first side of the connecting element in a first direction which points out of the plane of the flat part, first bending of the second conductors which are connected to the second side of the connecting element in a second direction which points out of the plane of the flat part, the second direction lying in an opposed manner with respect to the first direction, each of the method variants comprising, moreover:

folding of the connecting element along a folding axis which runs transversely with respect to the direction, in which the first and second conductors extend from the connecting element, with the result that the first conductors which extend from the first side of the connecting element lie in one plane next to or between the second conductors which extend from the second side of the connecting element, without making contact with one another, overmoulding of the folded flat part with an electrically insulating material, severing of the connecting element, and removal or cutting through of the webs which connect two adjacent contact pins.

7. The method according to claim 6 in the first variant, the second conductors which are connected to the second side of the connecting element being subjected to two bending operations which correspond to the first and the second bending operation, to which the first conductors of the connecting element which are connected to the first side have been subjected.

8. The method according to claim 6, one or more bends being effected in a region of the folded flat part before the overmoulding of the folded flat part, in which region the conductors which are connected to the first and the second side of the connecting element lie in one plane.

9. The method according to claim 6, further comprising:

separating of a part from the body which is produced by way of overmoulding, the separated part being mounted such that it can be displaced longitudinally along the conductors which are severed from the connecting element in a connector region of the plug.

10. A double-row plug for a ribbon or foil cable, comprising a flat part according to claim 1 and a body which is produced by way of overmoulding with an electrically insulating material.

11. The apparatus for the transmission of current with a ribbon or foil cable and at least one double-row plug according to claim 10 which is connected to the former in an electrically conducting manner.

12. The apparatus for the transmission of current according to claim 11, the ribbon or foil cable being wound up helically at least partially.

* * * * *